United States Patent [19]

Galyean

[11] 4,402,499

[45] Sep. 6, 1983

[54] TUNNEL WITH OFF-CENTER SHAFT THEREIN HAVING FURTHER SHAFTS SLIDEABLE THERETHROUGH

[76] Inventor: Rodney P. Galyean, 2080 Sutherland Pl., Hoffman Estates, Ill. 60195

[21] Appl. No.: 349,864

[22] Filed: Feb. 18, 1982

[51] Int. Cl.[3] ..... A63J 23/00

[52] U.S. Cl. ..... 272/1 R; 272/8 R; 272/8 D; 40/427; 40/429; 40/430

[58] Field of Search ..... 272/1 R, 8 N, 8 D, 8 R; 40/427, 429, 430; 273/153 R, 153 S; 74/DIG. 9

[56] References Cited

U.S. PATENT DOCUMENTS 2,607,158 8/1952 Wood ..... 272/8 R 2,798,324 7/1957 Berger et al. ..... 272/8 R

FOREIGN PATENT DOCUMENTS 501547 3/1939 United Kingdom ..... 272/1 R

*Primary Examiner*—Richard T. Stouffer

*Assistant Examiner*—William H. Honaker

*Attorney, Agent, or Firm*—Laff, Whitesel, Conte & Saret

[57] ABSTRACT

A mechanical device includes a block of material having a hollow tunnel formed therein. An elongated rotary shaft is floatingly mounted in the tunnel, generally parallel to but off-set from the longitudinal center thereof. A number of holes are diametrically formed through and more or less evenly distributed along the length of the shaft, perpendicular to the axis thereof. Each hole is angularly offset from the other holes, by a predetermined angular distance. A sliding shaft, which slides freely through each of these diametrical holes, has a wheel on each of its opposite ends. The contour of the tunnel wall is unique and is defined by the paths followed by the wheels on the ends of the sliding shafts, as the shaft rotates and as the sliding shafts slide freely through the holes.

8 Claims, 4 Drawing Figures

TUNNEL WITH OFF-CENTER SHAFT THEREIN HAVING FURTHER SHAFTS SLIDEABLE THERETHROUGH

This invention relates to entertaining devices and more particularly to devices having rotating and moving parts which do not appear to fit into the scheme of existing machinery.

Adult "toys" include many different forms of entertaining and educational machines. The Rubik's cube is currently an example of a device which may be manipulated to both entertain and educate. Often the more unique and unknown a device is, the more lasting and consuming its attention getting ability becomes.

Accordingly, an object of the invention is to provide a new and unique device having a plurality of moving parts. Here, an object is to provide a rotary device which may be utilized as a motion and movement demonstration device. In particular, an object is to provide a mechanical device, having a function which is not immediately apparent, to the casual observer.

Another object is to provide a rather simple mechanical device for accomplishing the foregoing objects, which device does not require a substantial amount of either cost or time for the assembly thereof.

In keeping with an aspect of the invention, these and other objects are accomplished by a block of material having a hollow tunnel formed therein. An elongated rotary shaft is floatingly mounted in the tunnel, generally parallel to the axis thereof. A number of holes are diametrically formed through and more or less evenly distributed along the length of the shaft, perpendicular to the axis thereof. Each hole is angularly off set from the preceding and the following holes by a predetermined angular distance. Thus, if a line is drawn along the surface of the shaft and through the centers of the opposite ends of the holes, theoretically a double spiral line is drawn along the length of the shaft, the spirals being off set by 180°, with respect to each. (Actually, the holes may be distributed in any suitable manner for mechanical strength.) A sliding shaft slides freely through each of these diametrical holes and has a wheel, roller or ball mounted on each of the opposite ends thereof. The contour of the tunnel wall is unique and is defined by the paths followed by the wheels on the ends of these sliding shafts, as the shaft rotates and as the sliding shafts slide freely through the holes.

A preferred embodiment of the invention is shown in the attached drawings, wherein.

Figure 1:
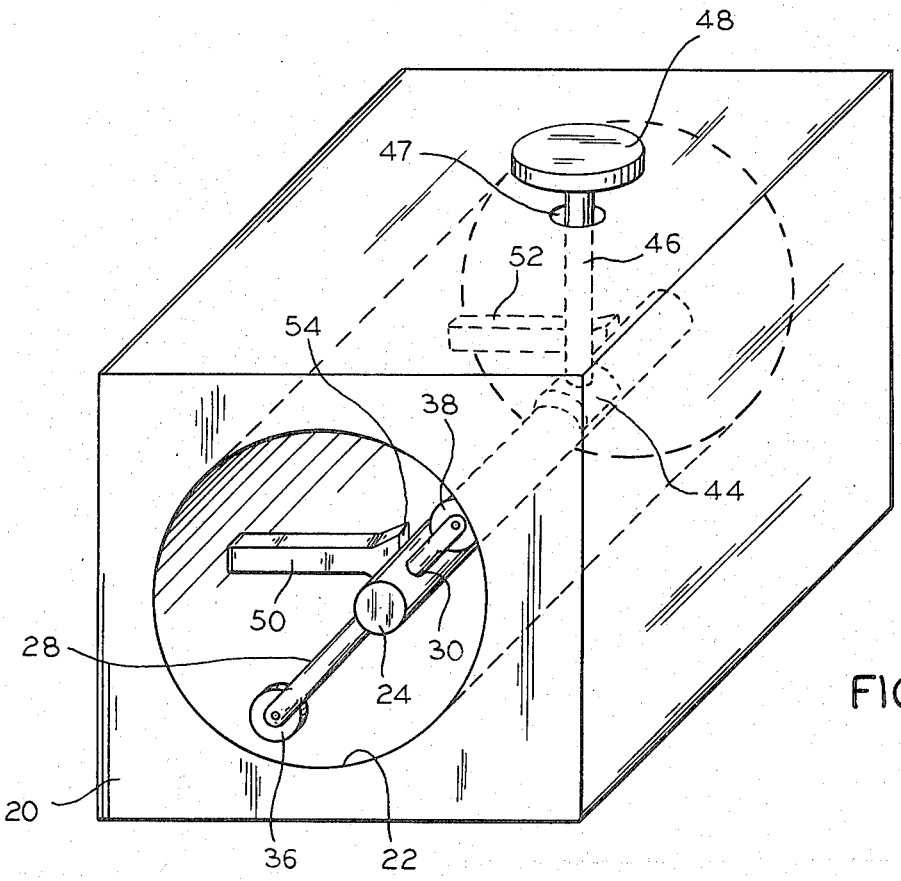
FIG. 1 is a perspective view of the inventive device.

In FIG. 1, a block 20 has a tunnel 22 formed therein. The tunnel is formed around a substantially straight axis and has substantially smooth walls; however, it is contemplated that in some more complex designs, the tunnel may have other suitable design configurations. For example, in some embodiments, the cross-section may be an ellipse with one end of the tunnel having a cross section which is somewhat rotated relative to the cross section of the other end. There may be an internal spiral of the cross-section, or other suitable effects. Accordingly, it should be understood that the tunnel wall may have any suitable contour for forming an internal roadway for the sliding shaft arms to follow.

Figure 2:
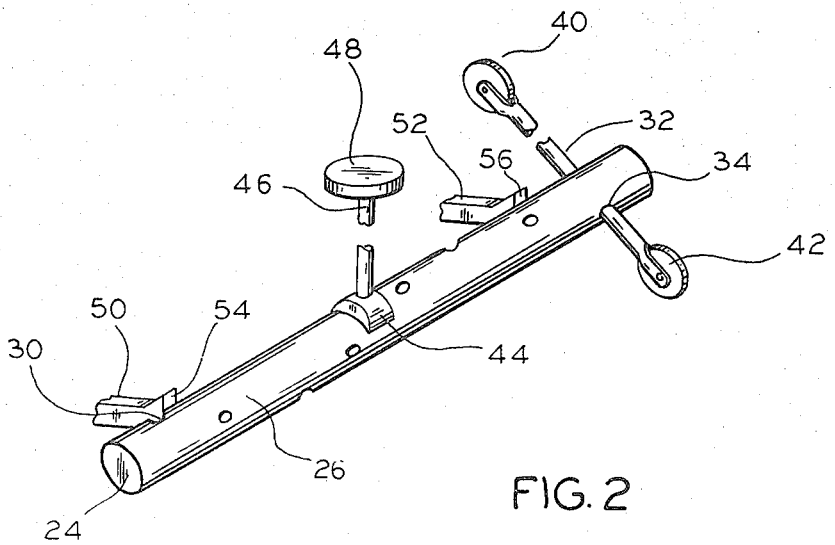
FIG. 2 is a perspective view of the shaft, removed from the device of FIG. 1, with one exemplary sliding shaft in place.

Horizontally mounted in the tunnel 22 and parallel to the axis thereof is a floating shaft 24, which is best seen in FIG. 2. This shaft has a number of holes (one is seen at 26) diametrically formed therein. The axis or the center of the cross-section of each hole is perpendicular to and passes through the axis of shaft 24. Each hole is angularly off-set relative to its neighboring holes. For example, FIG. 2 has been drawn to show a shaft having an exemplary eight holes. Therefore, the axis of each hole is off-set from the axis of its immediately neighboring holes by an angle of 22.5° ($180° \div 8 = 22.5°$). However, any other suitable relationship may also be provided.

A sliding shaft freely slides through each of these holes. For example, FIG. 1 shows a sliding shaft 28 sliding through a hole 30 while FIG. 2 shows a sliding shaft 32 sliding through hole 34. For simplicity and understandability of the drawings, the remaining sliding shafts are not shown, but it should be understood that a similar sliding shaft is provided for each of the shaft holes. Each sliding shaft has a wheel mounted on each of the two opposite sliding shaft ends. For example, sliding shaft 28 has wheels 36, 38 on its opposite ends, and sliding shaft 32 has wheels 40, 42 on its opposite ends. These wheels could be replaced by rollers or ball bearings, or the like. The contour of the tunnel wall forms an endless "roadway" which is defined by the paths which these wheels follow as the shaft rotates and as they roll along the "roadway".

Resting on top of the shaft is a shoe 44 which rides on the turning shaft. To facilitate operation, it may be desirable to reduce the friction between shoe 44 and shaft 24 to a minimum. For example, roller or ball bearings may be carried by or embedded in the bottom of the shoe 44.

A vertical shaft 46 slidably extends from shoe 44 upwardly and out of a hole 47 in the block 20. The top of vertical shaft 46 terminates in any suitable pad 48. If pressure is applied against pad 48, that pressure is transferred through vertical shaft 46 to the shaft 24. The geometrical relationships are such that this pressure is transferred to shaft 24, in a linear direction which passes through the axis of the shaft. For example, if the end of the shaft is viewed as the face of a clock with the 12 o'clock position uppermost, as viewed in the various drawings, the pressure upon pad 48 causes a net vector of force acting outwardly of the shaft 24.

Figure 3:
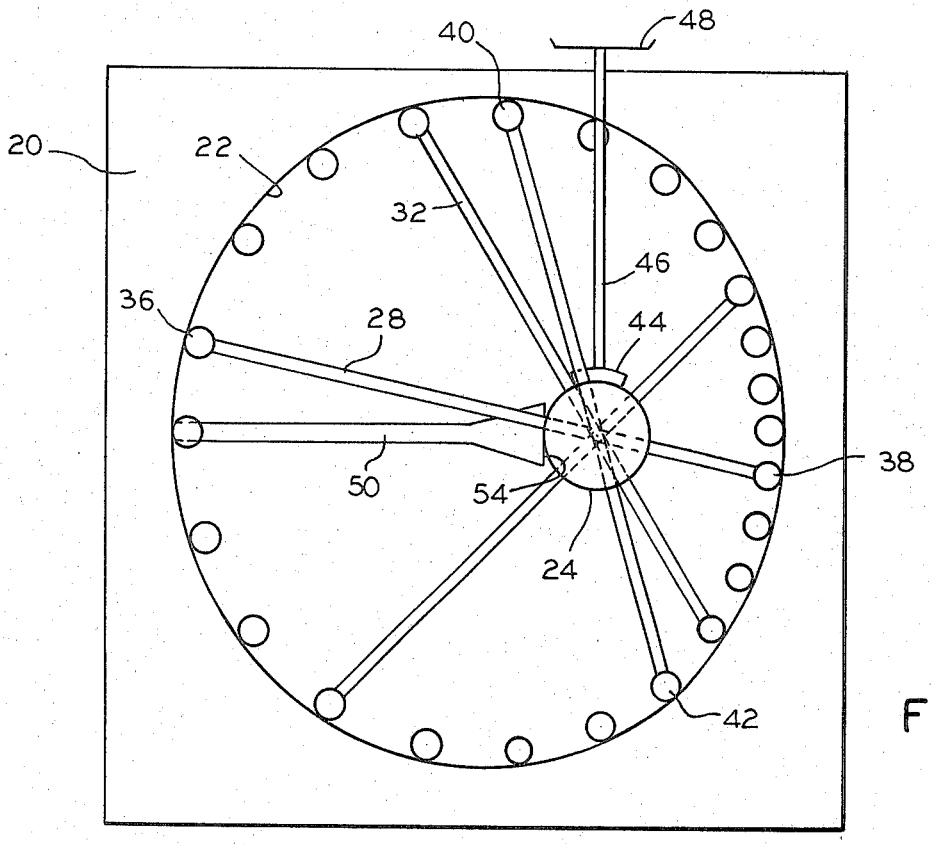
FIG. 3 is an end elevation view of the device with an exemplary four sliding shafts in place.

Inside the tunnel 22, there are any suitable, spaced parallel roller or ball bearings for preventing the floating shaft from moving toward the center of the tunnel. Thus, FIG. 1 shows arms 50, 52 having vertical faces 54, 56. These faces prevent the shaft from moving to a position which is left of them (as viewed in FIGS. 1–3). However, the shaft remains free to float and to move toward the right or up or down, as viewed in the various figures.

Figure 4:
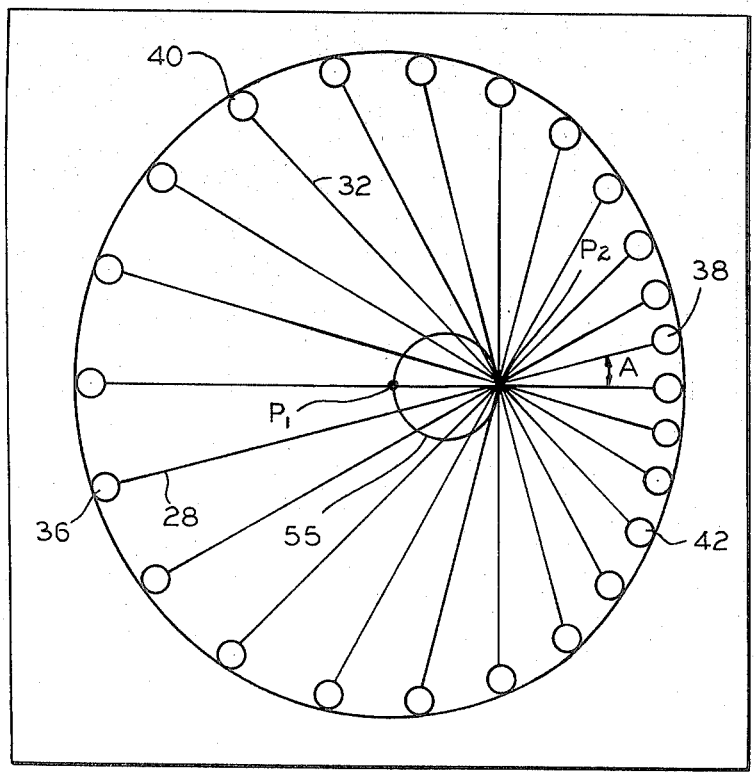
FIG. 4 graphically shows how the device is designed.

FIG. 4 shows the criteria for designing the device. As the shaft 24 rotates, the various sliding shafts slide through their individually associated diametric shaft holes. The center of the sliding shafts follows a locus 55, seen in FIG. 4, as the sliding shafts rotate about point P2. The locus is best described as a closed path, which may be a circle, for example, having a point P1 on the path which lies at the geometrical center of the tunnel and, diametrically opposed thereto, another point P2 on the path, point P2 being about halfway between the center point P1 and the wall of the tunnel 22. The radius R of circle 55 should be about $\frac{1}{8}$ as long as the sliding shafts (28, for example).

As the centers of the rotating sliding shafts follow the locus 55, the sliding shafts slide through the holes in the shaft, while their associated wheels roll along the inside of the tunnel wall.

Various modifications would change the number and distribution of the various sliding shafts. For example, to provide a better balance, there could be, say, three identical groups of sliding shafts distributed along the length of shaft 24 so that at each angular position, there is, in effect, three identical sliding shaft positions (in each sliding shaft direction) for supporting the opposite ends and center of the shaft 24. Likewise, any suitable number of the vertical shafts 46 may be distributed along the length of the shaft 24.

A person's fingers or a motor may be used or connected to turn shaft 24. In any event, the device gives a person something to look at, play with, and to try to figure out how or why it works.

Those who are skilled in the art will readily perceive how to modify the system. Therefore, the appended claims are to be construed to cover all equivalent structures which fall within the true scope and spirit of the invention.

I claim:

1. An attention getting device comprising a block having a tunnel extending through at least a part thereof, a floating shaft in an off-center position within said tunnel, at least one wall means in said tunnel for precluding a centering of said shaft in said tunnel, a plurality of holes formed diametrically through said shaft, the axis of each of said holes being angularly off-set with respect to the axis of each of the other holes in order to uniformly distribute the directions of said holes around the periphery of said shaft, a sliding shaft slidably positioned in each of said shaft holes, the contour of the wall of said tunnel conforming to the paths followed by the ends of said sliding shafts as said floating shaft rotates, and means for applying a pressure upon said floating shaft at a longitudinal location which is peripherally offset from the cross-sectional center of said floating shaft.

2. The device of claim 1 wherein the centers of said sliding shafts follow a locus which is a closed path having one point which coincides with the center of the tunnel and another diametrically opposed point which is approximately one half of the distance between said center and a wall of said tunnel.

3. The device of claim 2 wherein the closed path is a circle with radius which is equal to approximately one-eighth of the length of said sliding shaft.

4. A combination floating shaft and roadway wherein said floating shaft has a plurality of holes distributed along the length of said shaft, each of said holes having a cross-section centered upon a longitudinal axis of said shaft, said holes being oriented to radiate uniformly around the periphery of said shaft, a sliding shaft passing freely through each of said holes, rotary means on each end of each of said sliding shafts, said rotary means being oriented to roll as said floating shaft rotates, means defining said endless roadway around said floating shaft for said wheels to roll on as said floating shaft rotates, and means for restraining motion of said floating shaft in one direction while enabling it to move freely in other directions.

5. The floating shaft of claim 4 and means for applying pressure on the pheriphery of said floating shaft in a direction substantially perpendicular to the axis of said floating shaft.

6. The floating shaft of claim 5 wherein said means for restraining motion of said floating shaft is at least one vertical bearing extending outwardly from said roadway toward a geometrical center of said roadway.

7. The floating shaft of any one of the claims 4–6 wherein a line drawn smoothly through the centers of opposite ends of said shaft holes forms two spiral lines along the surface of said shaft, the two spirals being offset 180° from each other.

8. The floating shaft of any one of claims 4–6 wherein said shaft holes are distributed along the length of said shaft to provide a balanced mechanical support thereof.

* * * * *